United States Patent [19]

Shell

[11] 4,065,088

[45] Dec. 27, 1977

[54] UPRIGHT AND BRACKET ARRANGEMENT

[76] Inventor: Irving W. Shell, 442 Wellington Ave., Chicago, Ill. 60657

[21] Appl. No.: 604,145

[22] Filed: Aug. 13, 1975

Related U.S. Application Data

[63] Continuation-in-part of Ser. No. 500,574, Aug. 26, 1974.

[51] Int. Cl.[2] ..... A47G 29/02

[52] U.S. Cl. ..... 248/242

[58] Field of Search ..... 248/241, 242, 354 C

[56] References Cited

U.S. PATENT DOCUMENTS

| | | | |
|---|---|---|---|
| 3,538,860 | 11/1970 | Fisher | 248/242 |
| 3,572,626 | 3/1971 | Bertschi | 248/242 |
| 3,729,161 | 4/1973 | Christensen | 248/242 |

FOREIGN PATENT DOCUMENTS

| | | | |
|---|---|---|---|
| 224,297 | 4/1962 | Austria | 248/242 |
| 1,243,477 | 9/1970 | France | 248/242 |
| 255,882 | 1/1913 | Germany | 248/242 |
| 723,219 | 6/1942 | Germany | 248/354 C |
| 113,071 | 5/1968 | Norway | 248/242 |
| 702,271 | 1/1954 | United Kingdom | 248/354 C |

*Primary Examiner*—William H. Schultz
*Attorney, Agent, or Firm*—Vogel, Dithmar, Stotland, Stratman & Levy

[57] ABSTRACT

A combination channel post and bracket including abutting means for removably securing the bracket to the post, and enabling the vertical level of the bracket to be incrementally varied along the post. The abutting means may include an upper rod for contacting the inside of the post and a lower rod for contacting the outside of the post, and a cam for also contacting the outside of the post. The rotation of the cam provides a fine adjustment of the slant of the bracket, and simultaneously locks the bracket at the new adjusted position. For purposes of exacting adjustability, the lower rod and cam may have several removable positions on the bracket for precisely varying the incline of the bracket. A spacer may be positioned between the post and the cam, to enable the cam to provide fine adjustment of the slant of the bracket and to lock the bracket in place, for the several different positions of the lower rod on the bracket, including a reverse slant position.

The channelled post may comprise a pair of spaced apart front flanges to define a gap having a width dimension less than the length of the upper rod, the lower rod or the cam, so that the rods and cam bridge the gap to abutt both flanges, when the bracket is operatively mounted onto the post. The upper rod includes an operative-position when bridging the gap and contacting the inside of the post, and a nonoperative-position to enable the upper rod to pass through the gap and into the inside (or outside) of the post. One or more of the combinations of post and bracket may be used to support a shelf.

A shelf grip may be removably secured anywhere along the length of the post, for clamping the shelf between the grip and the bracket. Also, a book or shelf end may be removably secured anywhere along the post, as an end guard, top, center or bottom of shelf removable and adjustable.

7 Claims, 21 Drawing Figures

UPRIGHT AND BRACKET ARRANGEMENT

REFERENCE TO OTHER APPLICATION

This application is a continuation-in-part of my patent application entitled "Adjustable Bracket", Ser. No. 500,574, filed Aug. 26, 1974.

BACKGROUND OF THE INVENTION

Generally, the previously used shelf supports included uprights having a plurality of vertically spaced notches for engaging brackets. Many of these brackets had cutouts formed therein so that the bracket straddled and abutted the bottom defining edge of a selected notch. In some cases the cutouts were formed at different angles to afford means for adjusting the incline of the bracket. These prior shelf supports, however, had limited capability for adjusting the angle of the bracket for supporting a shelf. Also, the position of the bracket along the upright was restricted by the number of notches and the spacing between notches and did not lock securely thereto.

In British Pat. No. 989,083 (1965) a channelled support upright is illustrated having a continuous and vertical opening or guideway, and a substantially T-shaped shelf support bracket is movable along the opening. A plurality of insert pieces are removably fitted inside the upright, above and below the bracket, for securing the bracket at a selected position. The inner end of the British bracket is not dimensioned to pass through the opening, but may be positioned inside the upright from the open top or bottom ends. In the subject invention, the engaging part of the bracket includes a nonoperative-position for passing through the continuous vertical opening of the upright and an operative-position for securing the bracket inside the upright.

In my aforesaid patent application, the cam was essentially only used for varying the slant of the bracket at or near the level position. When the lower abutting rod was inserted into an inner aperture to cause a more downward slant, the cam was displaced too far outward, and thus provided very little, if any, adjustability, and was also loose and did not make secure contact. In the subject patent application, a spacer or shim is provided for inserting between the cam and the upright, so that the full adjustability of the cam may be utilized even in the downward slant position, for securely locking the bracket in place.

Furthermore, in my said prior patent application, the described embodiment defined and illustrated the cam member including a pair of convex heads having a neck connected between and off center to the heads. I have found that by constructing the cam member to have a convex abutting side and a flat side opposite to the convex side, a more positive locking action is achieved. This type cam affords greater "fine" adjustability of the bracket, position, and provides means for easily inserting the cam in place prior to locking the bracket at the selected position.

It is a primary object of the subject invention to provide an adjustable shelf support including a bracket which is adjustable over a wide range and locked at any new adjusted position.

Another primary object is to provide a bracket that is securely mountable along the vertical length of an upright, and the slant of the bracket may be varied over a wide range at any vertical mounted position, up or down.

Another object is to provide means for incrementally and precisely adjusting the slant of a shelf supporting bracket and locking the bracket at any such new adjusted position.

Another object is to provide a shelf supporting bracket having a rotatable cam means for abutting the upright, whereby upon rotation thereof the angle of the bracket with respect to the upright may be incrementally varied and simultaneously locked at the new angular position.

Another object is to provide different locations on the bracket for removably inserting a lower bar and/or a cam means, for appreciably increasing the angular range of bracket adjustment.

Another object is to provide a shelf support bracket mountable on a channelled upright and an upper locking bracket or shelf grip also mountable on the upright for clamping a shelf therebetween, to eliminate vibrations. A related object is to provide the upper locking bracket to permit the overlapping of shelves without the need of the usual frontal hook to function as a stop to lock the shelf in place.

Another object is to provide a shelf support bracket mountable on a channelled upright and a shelf end or book end also mountable on the same channelled upright.

A feature of the subject invention is to provide a spacer for inserting between an upright and a cam positioned on a shelf support bracket, so that the cam may be fully utilized even when the bracket is in a downward slanted position from the upright.

Another feature is to provide a cam having a convex side and a flat side, for precisely setting the slant of the bracket and locking the bracket at such setting.

In my invention I incorporate into one single bracket unit an upper, inside rod member to slide and select the desired vertical position which is infinitely variable. A lower rod member acts as a stabilizer to eliminate wobble within the upright. In conjunction with this I provide a cam and optional shim which together function to tightly lock the bracket in all positions thereby avoiding the dependence on gravity and eliminating accidents.

My invention utilizes a simple, strong and practical level bracket which is much stronger than the usual hook brackets of the prior art. Furthermore, instead of requiring a user to special order brackets with holes and pins to provide special slants I provide a multi-slant unit as one without distorting or weakening the original level bracket.

BRIEF DESCRIPTION OF THE DRAWINGS

Referring to the drawings in which the same characters of reference are employed to indicate corresponding or similar parts throughout the several Figures of the drawing.

DESCRIPTION OF THE PREFERRED EMBODIMENTS

Figure 1:
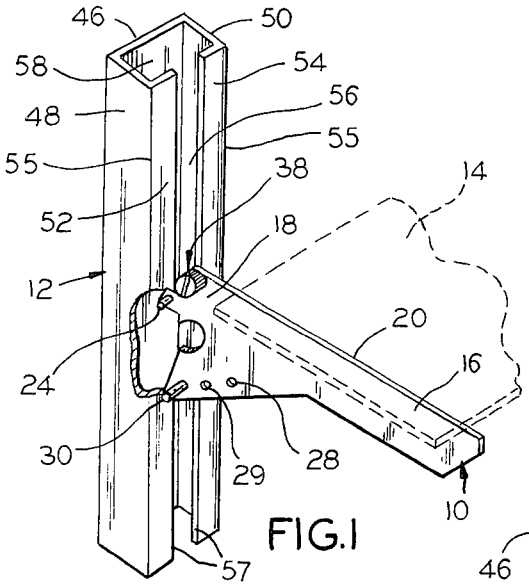
FIG. 1 is a perspective view of an adjustable shelf bracket and upright post, embodying the principles of the invention.
Figure 2:
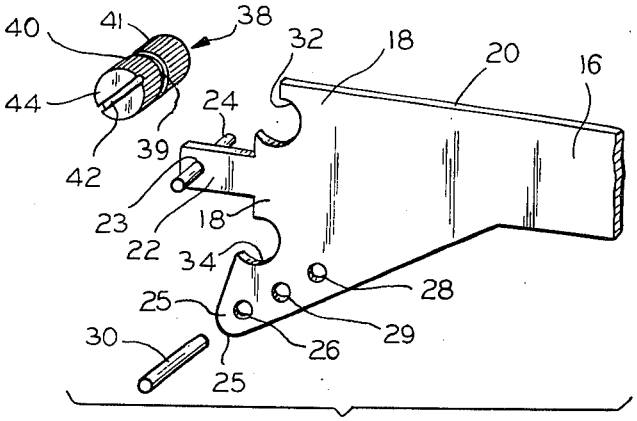
FIG. 2 is a fragmentary perspective view of the bracket and showing the removable parts of the bracket spaced outwardly therefrom.

Referring now specifically to FIGS. 1 through 8 of the drawing, the reference number 10 indicates generally an adjustable shelf bracket for removably mounting onto an upright channel post or upright 12. Normally, a pair of brackets 10 and posts 12 are used for supporting a shelf 14. The position of the bracket 10 may be incrementally varied along the vertical length of post 12. The bracket 10 may be positioned horizontally and locked (FIG. 4), inclined slightly upwardly (also FIG. 4), inclined upwardly (FIG. 5) or inclined downwardly (FIGS. 6 and 7), at virtually any vertical level along support upright 12.

The bracket 10 includes a shelf support portion 16 and a post engaging portion 18. The support portion 16 has a straight upper edge 20 on which shelf 14 is positioned.

The engaging portion 18 of bracket 10 includes an outward protruding lug 22 having an aperture 23 formed therein. An upper rod 24 fixidly extends through the aperture 23.

Figure 4:
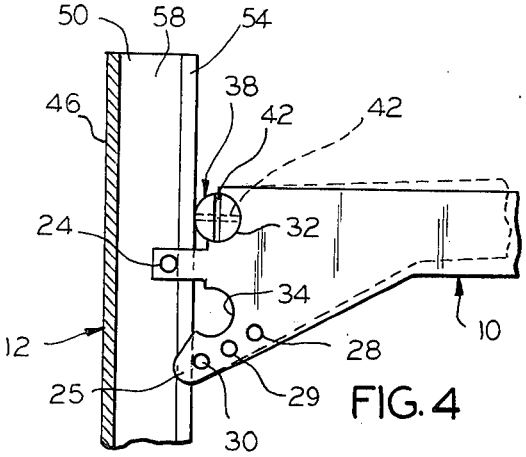
FIG. 4 is a fragmentary side elevational view of the bracket when it is in a level position and also showing the bracket in phantom in an upwardly reverse slant position.
Figure 6:
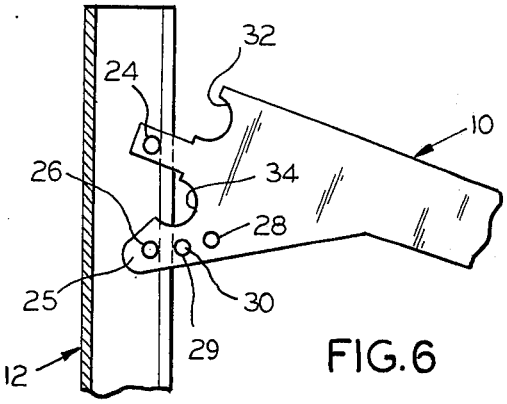
FIG. 6 is a fragmentary side elevational view of the bracket when the lower rod is inserted through the middle aperture.
Figure 7:
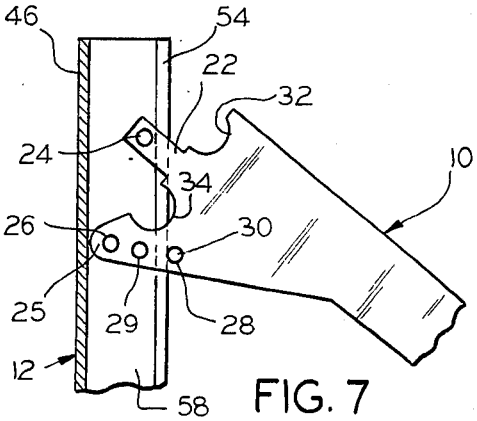
FIG. 7 is a fragmentary side elevational view of the bracket when the lower rod is inserted through the innermost aperture to illustrate a more downwardly inclined position of the bracket.

The engaging portion 18 also includes a protruding thumb 25 inclined in a downward and outward direction having an outer aperture 26, an inner aperture 28 and a middle aperture 29 formed therein to removably receive a lower abutting rod 30. Apertures 26, 28 and 29 are positioned below the upper rod 24. When lower rod 30 is inserted into aperture 26 the bracket 10 is in the horizontal or level position (FIG. 4). When rod 30 is inserted into aperture 29, the bracket 10 is inclined downward (FIG. 6). When the rod 30 is positioned in aperture 28, the bracket is further downwardly inclined than when rod 30 is positioned in aperture 29, as shown in FIG. 7.

The engaging portion 18 of bracket 10 also includes an upper notch 32 formed above the upper rod 24 and a lower notch 34 formed below the lower rod 24. A cam means indicated generally by reference numeral 38 is received inside the notches 32, 34. The cam means 38 includes a central circular collar 39 integrally formed to a pair of opposed heads 40 and 41, which press fits inside the notches 32, 34.

Figure 3:
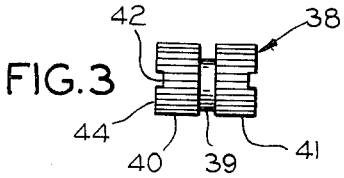
FIG. 3 is a front view of a convex cam means.

Collar 39 as may be seen in FIG. 3, is connected off center to the heads 40, 41. Heads 40 and 41 each has a groove 42 formed on the outer face 44 thereof, to receive a conventional screw driver or other suitable tool for turning the cam 38 and thereby provide a fine adjustment of the incline and locking bracket 10 at the desired setting.

The channel post 12 comprises a rear wall 46 integrally connected to side walls 48, 50. Flanges 52, 54 are bent inward from the outer edges 55 of side walls 48, 50. A longitudinal gap 56 separates the inner most edge 57 of flanges 52, 54. The walls 46, 48, 50 and flanges 52, 54 define a channel 58 which communicates with gap 56. The horizontal dimension of gap 56 is less than the horizontal dimension of the upper rod 24, lower rod 30 and cam means 38. When bracket 10 is in the operative position, the upper rod 24, lower rod 30 and cam means 38 bridge the gap 56. The upper rod abutts the inside surface of the flanges 52, 54 and the lower rod 30 and cam means 38 abutt the outside surfaces of flanges 52, 54. As may be seen in FIGS. 6, 7 and 8, the thumb 25 of the bracket passes through gap 56 and into channel 58.

Turning now to FIGS. 4 through 8, various operative positions for bracket 10 will be described with greater detail. In FIG. 4, the lower rod 30 extends through aperture 26, and cam means 38 is press fitted in the notch 32. Lug 22 of the bracket 10 extends through gap 56 and into the channel 58, and the upper rod 24 bridges the gap 56 and abutts the inside surfaces of flanges 52, 54. The outer end of thumb 25 is in the gap 56 and the lower rod 30 bridges the gap 56 and abutts the outside surface of flanges 52, 54. The head 40 of cam 38 abutts the outside surface of flanges 52 and the other head 41 abutts the outside surface of flange 54. Upon rotating the cam means 38 with a screw driver or other suitable tool inserted in the groove 42, the incline of the bracket is slightly adjustable as the abutting heads 40, 41 move inward or outward from the flanges. In FIG. 4, the bracket is shown in phantom raised approximately three degrees from the level position.

Figure 5:
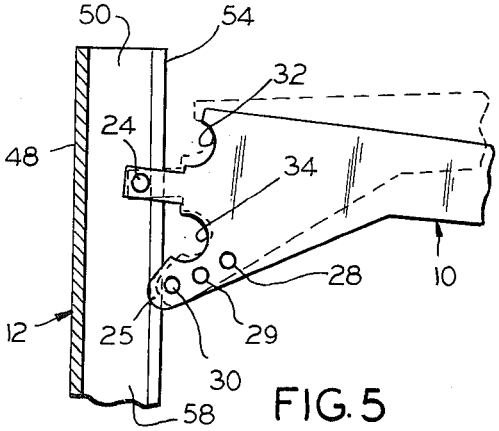
FIG. 5 is a fragmentary side elevational view of the bracket and also showing the bracket in phantom in a reverse slant raised position.

In FIG. 5, the bracket 10 is shown without the cam means 38 and the lower rod 30 is still positioned in aperture 26. The bracket position shown in phantom is a reverse slant, with the bracket functioning in conjunction with rod 30.

In FIG. 6, the lower rod 30 is press fitted into aperture 29, to provide a more downward slant of bracket 10 than when the lower rod 30 is inserted into aperture 26. As shown, a greater portion of thumb 25 has passed through the gap 56 and into the channel 58. FIG. 7 illustrates a still more downward slant for the bracket 10, as the thumb 25 passes further into channel 58 when the lower rod 30 is positioned through aperture 28. Therefore, the removal of the lower rod 30 from aperture 26 and inserting it into aperture 28 or 29 affords a wide slant variation for the bracket 10.

Figure 8:
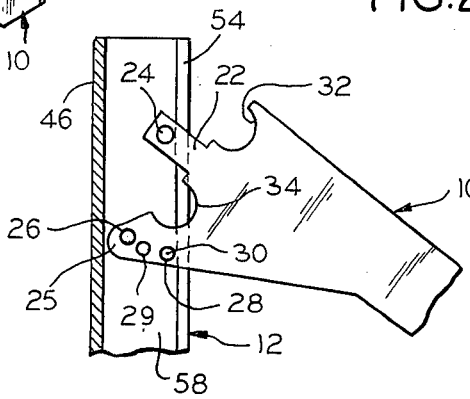
FIG. 8 illustrates the bracket in the most downwardly inclined position.

In FIG. 8, the lower rod 30 is positioned through aperture 28, and the upper and lower rods 24 and 30 both abutt the inside of flanges 52 and 54. This provides a more downward slant than shown in FIG. 7.

Figure 18:
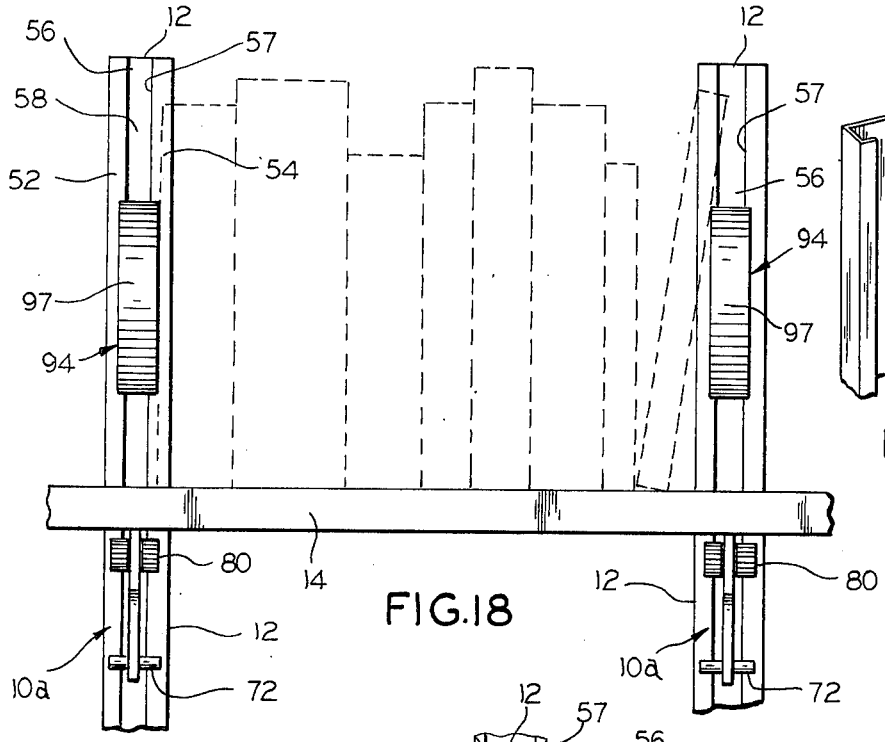
FIG. 18 illustrates a pair of the shelf ends of FIG. 16 utilized as a book stop or book ends with books shown in phantom there between, and showing a shelf resting on a pair of adjustable support brackets.

Referring now to FIGS. 9 and 12 through 15, the reference 10*a* indicates generally another primary embodiment for an adjustable bracket for removably positioning onto the upright channel post 12, and suitable for supporting the shelf 14. The bracket 10*a* includes an upright engaging portion 59 and a shelf support portion 60 having a straight upper edge 61 on which the shelf 14 is mounted (FIG. 18).

Bracket 10*a* includes an outward exending lug 63 having an aperture 64 formed therein. An upper rod 65 fixidly extends through aperture 64. The lower end 66 of the bracket engaging portion 59 includes an outer aperture 68, a middle aperture 69 and an inner aperture 70 formed therein, to removably but tightly receive a lower abutting rod 72. Apertures 68, 69 and 70 are positioned below the upper rod 65.

An upper cutout 73 is formed above the upper rod 65 and a lower cutout 74 is formed below the upper rod 65. The cutout 73 or 74 is defined by an inward concave or arcuate edge 76. The upper cutout 73 links with the flat upper edge 78 of lug 63. A cam member indicated by reference 80 press fits within either cutout 73 or 74.

The cam member 80 includes a convex or an arcuate side 82 and a flat side 84 opposite thereto. The convex side 82 includes a pair of spaced apart and opposed convex heads 86, 87 integrally connected together by a convex neck 88 recessed inward with respect to the outer periphery of the heads 86, 87.

Figure 10:
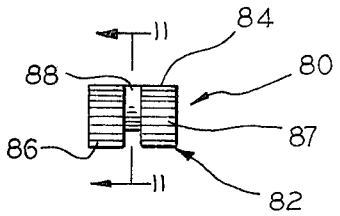
FIG. 10 is a front view of another type cam, also embodying the principles of the invention.
Figure 11:
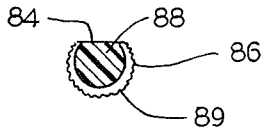
FIG. 11 is a sectional view of the cam in FIG. 10, taken on the plane of the line 11—11 in FIG. 10, and viewed in the direction indicated.
Figure 9:
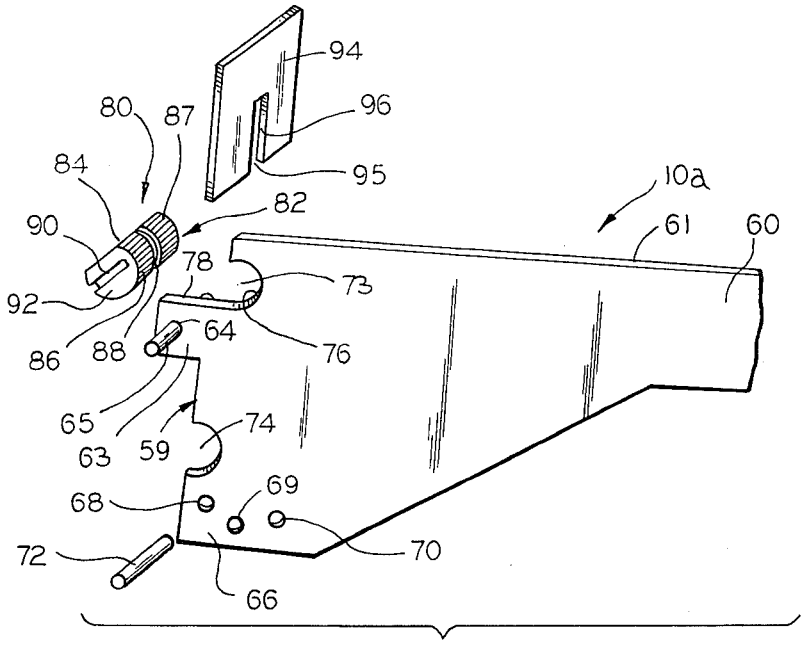
FIG. 9 is a fragmentary perspective view of another primary embodiment of the adjustable shelf bracket, showing the removable parts spaced outward from the bracket.

The neck 88 of cam 80 press fits into the cutout 73 or 74. The neck 88 is attached off center to the heads 86, 87. The distance from the outer pheriphery of the neck 88 to the outer periphery of the head varies, as may be seen specifically from FIG. 10.

Head 86 has a groove 90 formed on the end face 92 thereof. A conventional screw driver or other suitable tool may be inserted into groove 90, for turning the cam member 80, and thereby providing a fine adjustment of the incline of the bracket 10*a* and simultaneously locking the bracket 10*a* at such fine adjusted position.

The cam member 80 is easily inserted into cutout 73 (or 74), by positioning the flat side 84 either at the top or bottom of the cutout 73 (or sliding the flat side 84 on the flat edge of lug 23 when inserting into cutout 73), and the convex neck 88 is received within the concave cutout 73. A slight turn of cam member 80 from the initial position secures the cam inside the cutout 73.

By turning the upper rod 65 so that the length thereof is vertical or parallel to the upright 12 (nonoperative-position of rod 65), the upper rod 65 and lug 63 may be passed through the gap 56 and into the channel 58 of the upright. Upon turning the upper rod 65 90° so that it extends across the width of the gap 56, the upper rod 65 is then locked inside the channel 58 (operative-position). Therefore, regardless of the length of the upright 12, there is no problem in securely positioning the bracket 10*a* along the vertical length thereof. However, before inserting the upper rod 65 into the channel 58, the cam 80 should be turned so that the flat side 84 is opposed to or facing toward the upright 12, otherwise the convex side 82 of the cam 80 may prevent the upper rod 65 from passing through the gap 56. After the upper rod is locked inside the upright 12, the cam 80 is adjusted for locking the bracket 10*a* at the precise desired slant.

When the lower abutting rod 72 is positioned through the outer aperture 68, the cam member 80 provides fine adjustment of the slant of the bracket 10*a* at or near a level position (FIG. 12) and simultaneously locks the bracket 10*a* at the new slant position. The locking action at the precise adjustment point is primarily due to the positive abutting force provided by cam 80, which prevents bracket 10*a* from slipping, even slightly from the set angle.

Figure 14:
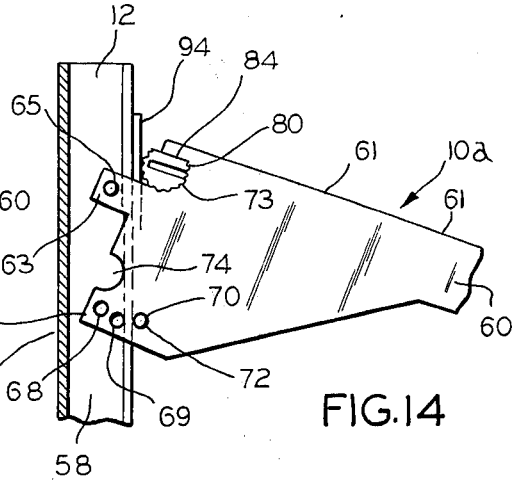
FIG. 14 illustrates the adjustable shelf bracket of FIG. 13 in a more downward slant position.

A spacer or shim 94 (FIGS. 9, 13 and 14) is provided for inserting between the upright 12 and the cam member 80, when the lower rod 72 is positioned in the middle aperture 69 or in the inner aperture 70. The shim 94 includes a rectangular slot 95 having defining edges 96, for straddling the lug 63, when the shim 94 is operatively positioned. Thus, the convex heads 86, 87 of cam 80 abutt the shim 94 for transmitting the force against the upright 12 (FIGS. 13 and 14). Without shim 94, the cam 80 could not be used, since it would be spaced from the upright 12. When the lower rod 72 is positioned in the outer aperture 68, the convex heads 86, 87 of cam 80 directly abutt the outside of the upright 12 (FIG. 12).

Figure 12:
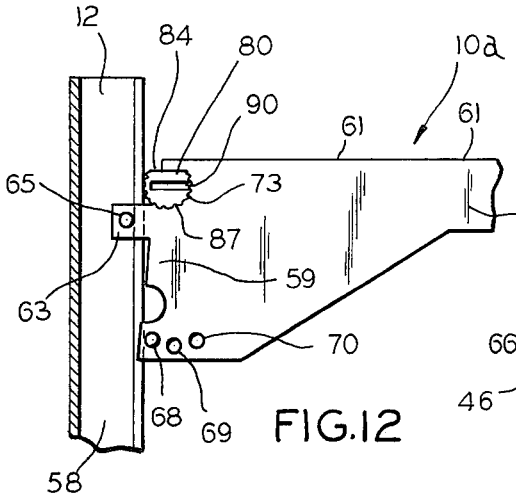
FIG. 12 illustrates the adjustable shelf bracket of FIG. 9 in a level position.
Figure 13:
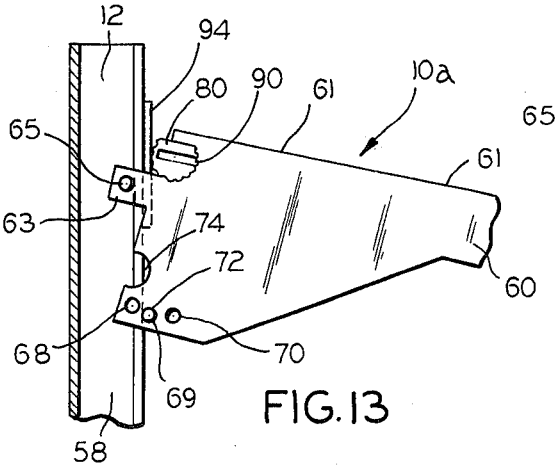
FIG. 13 illustrates the adjustable shelf bracket of FIG. 9 in a downward slant utilizing the cam in FIG. 10 and a spacer.

Referring now to FIGS. 12 through 15, the various operative positions for bracket 10*a* will be described with greater detail. In FIG. 12, the lower rod 72 is positioned in the outer aperture 68 and cam member 80 is press fitted into the upper cutout 73. The bracket 10*a* is substantially level in this position, and the convex side 82 of cam member 80 spans across the gap 56 and abutts the outside of flanges 52, 54. Upon rotating the cam member 80 with a screw driver or other suitable tool inserted into the groove 90, the slant of the bracket 10*a* may be incrementally and precisely varied. The abutting action of the cam member 80 enables the bracket 10*a* to be securely locked at any new slant position.

In FIG. 13, the lower rod 72 is inserted through the middle aperture 69 of bracket 10*a*, and the cam member 80 is inserted into the cutout 73. In order to utilize the fine adjustment provided by cam 80, the shim 94 is positioned over the lug 63 and is sandwiched between the flanges 52, 54 of the upright 12 and the cam member 80. As shown, the cam 80 abutts the shim 94.

In FIG. 14, the lower rod 72 is inserted through the inner aperture 70 of bracket 10*a*, and the cam member 80 is inserted in the cutout 73. Shim 94 is in place between the upright 12 and the cam 80. The lower rod 72 in the inner aperture 70 affords a greater downward slant of the bracket 10*a* than when the rod 72 is in the intermediate aperture 69.

Figure 15:
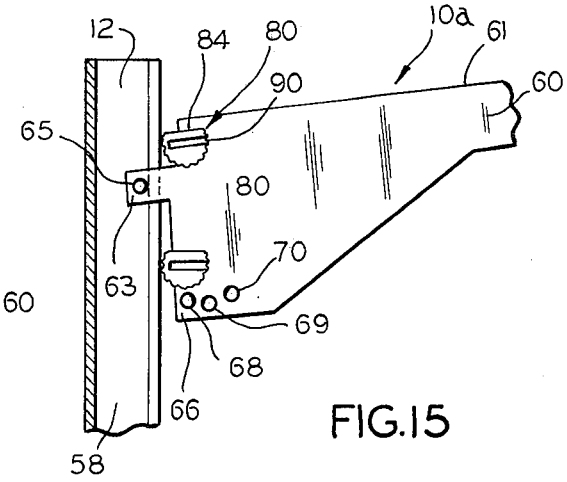
FIG. 15 illustrates the adjustable shelf bracket of FIG. 9 in an upward slant, utilizing two of the cams of FIG. 10.

In FIG. 15 the bracket 10*a* is shown in an upward slant. A cam member 80 is placed in the upper cutout 73 and another cam member 80 is inserted in the lower cutout 74. The cam members 80 cooperating together cause the bracket 10*a* to tilt upward. By adjusting the cams 80 the upward slant may be precisely set, and simultaneously locked at such upward slant position. If the lower end 66 of the bracket engaging portions 59 were angled further outward (as the thumb 25 in bracket 10 shown in FIG. 2) or if the cutout 74 were formed deeper into the bracket, the lower rod 72 may also be inserted through aperture 68 and provide additional slant control.

Figure 16:
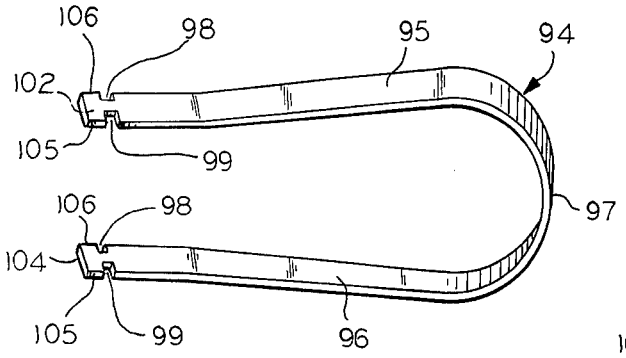
FIG. 16 is a perspective view of a shelf end or book end, embodying the principles of the invention.
Figure 17:
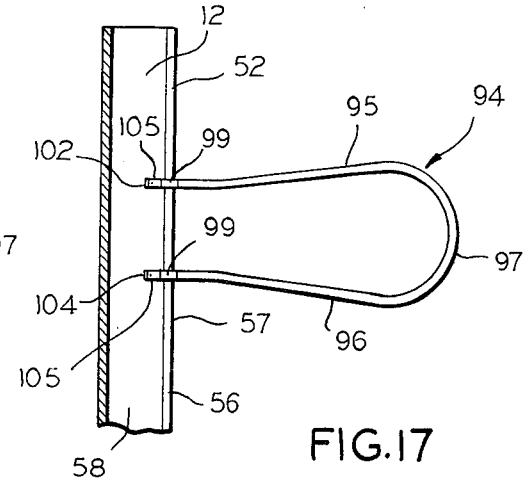
FIG. 17 illustrates the shelf end of FIG. 16 removably locked in the upright.

Referring now to FIGS. 16, 17 and 18 shelf end or book end indicated generally by reference numeral 94 is shown. The book end 94 is a spring having a substantially U shape including a pair of legs 95, 96 integrally connected together by a loop 97. The side holder 94, may be removably positioned anywhere along the upright 12. Two side supports 94 are shown in FIG. 18 for supporting books on the shelf 14.

A pair of opposed notches 98, 99 are formed in each leg 95, 96 adjacent to the corresponding outer ends or terminating feet 102, 104 thereof. The notches 98, 99 are dimensioned slightly larger than the thickness of flanges 52, 54. Legs 95, 96 are straight from the feet 102, 104 until a bend line 105, and thereafter the legs 95, 96 curve outward.

Figure 21:
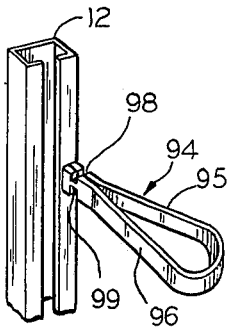
FIG. 21 is a perspective view illustrating the shelf end prior to being inserted inside the upright on or after removal from the upright.

When the legs 95, 96 are pressed or squeezed together and positioned so that the side ends 106 of feet 102, 104 extend or point in the vertical direction, (nonoperative-position), the feet 102, 104 may then be inserted through the gap 56, as shown in FIG. 21. The feet 102, 104 should extend a short distance into the channel 58 until the notches 98, 99 are opposed to the flanges 52, 54. The legs 95, 96 should then be turned ninety (90)° (see FIG. 17) so that the flanges 52, 54 are received in the notches 98, 99, to resiliently lock the bookend 94 inside the upright 12 (operative-position). The ends 106 of feet 102, 104 now point in the horizontal direction and the feet 102, 104 bridge the gap 56 of the upright 12. To remove the book end 94 from the upright 12, the legs 95, 96 are forced or squeezed together, and then turned 90°, so that the ends 106 of feet 102, 104, point in the vertical direction, and are thereby easily pulled out from the gap 56, as also may be seen in FIG. 21. Thus, the book end 44 may be inserted or removed from the upright 12 anywhere along the upright, and may be resiliently locked in place anywhere along the length of the upright 12.

Figure 19:
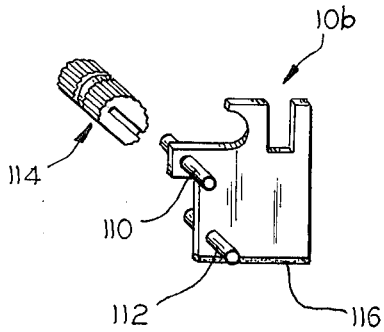
FIG. 19 illustrates an upper shelf grip embodying the principles of the invention.
Figure 20:
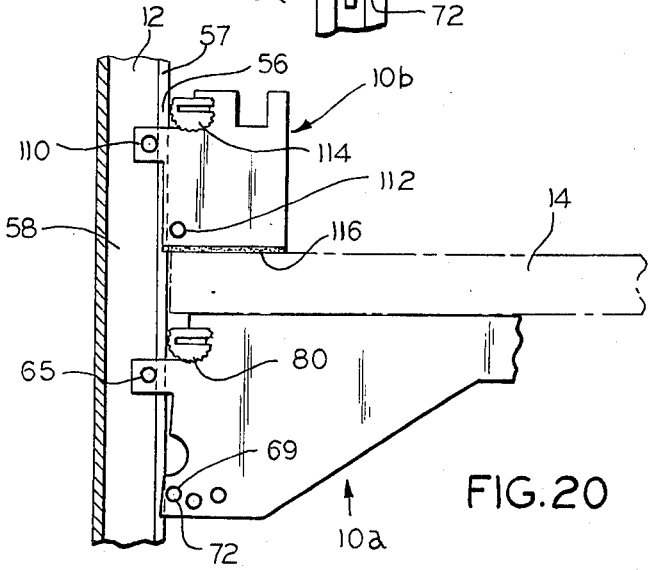
FIG. 20 illustrates the upper shelf grip cooperating with the shelf supporting bracket for clamping a shelf therebetween.

Turning now to FIGS. 19 and 20, an upper locking bracket or shelf grip indicated generally by reference numeral 108 is shown for securing the shelf 62 between the upper bracket 108 and bracket 10 or 10*a*. The shelf grip 108 includes an upper abutting rod 110, a lower abutting rod 112 and a cam means 114 positioned in cutout 115. The cam means 114 securely locks the upper locking bracket 108 in position. A length 116 of felt or other suitable non-abrasive material is cemented or otherwise secured to the bottom end of the shelf grip 108.

In FIG. 20, bracket 10*a* is level and secured in place by the cooperation of the upper rod 65, lower rod 72 positioned in the outermost aperture 69 and the cam means 80. The shelf grip 108 has been lowered into contact with the shelf 14 and thereby clamps the shelf between the shelf grip 108 and the support bracket 10*a*. The felt 116 prevents the top of the shelf 14 from being marred when the shelf grip 108 is in contact therewith.

It should be particularly noted that the bracket 10 and/or 10*a*, the book end 94 and the shelf grip 108 may be positioned virtually anywhere along the entire length of the upright 12.

It will be appreciated that numerous changes and modifications can be made to the embodiments described herein without departing from the spirit and scope of the invention.

I claim:

1. In an upright support member and bracket, said bracket comprising:
   - a first abutting means for contacting the inside of said support member;
   - a second abutting means for contacting the outside of said support member, the cooperation of said first and second abutting means enabling the vertical position of said bracket to be incrementally varied along the length of said support member;
   - a third abutting means for contacting the outside of said support member for finely setting the slant of the bracket and locking it in position; and
   - said support member including a rear wall, opposed side walls and a flange extending inward from each of the side walls to define a gap therebetween, said walls and flanges defining a channel communicating with a gap, said first abutting means contacting the inside of the flanges and spanning the width of said gap, and said second and third abutting means contacting the outside of the flanges and also spanning the width of said gap.

2. In an upright support member and bracket, said bracket comprising:
   - a first abutting means for contacting the inside of said support member;
   - a second abutting means for contacting the outside of said support member, the cooperation of said first and second abutting means enabling the vertical position of said bracket to be incrementally varied along the length of said support member; and
   - a cam means including a pair of opposed and spaced apart heads connected together by a neck, said heads operatively contacting the outside of said support member, the rotation of said cam finely varying the slant of the bracket with respect to the support member and locking said bracket in place at the desired slant.

3. The support member and bracket of claim 2, wherein said bracket includes a notch for receiving said neck of the cam.

4. The support member and bracket of claim 2, wherein said bracket includes a notch formed therein said neck press fitting in said notch.

5. The support member and bracket of claim 4, wherein said heads are circular and said neck is connected between and off center to said heads and thereby varying the slant of the bracket when the neck and heads rotate.

6. The bracket of claim 2, wherein said cam means includes a spacer for positioning between the cam member and the upright, so that said cam member contacts the spacer when applying said force.

7. The bracket of claim 6, including a nose and said spacer including a slot having defining edges, whereby such defining edges straddle said nose when the spacer is positioned between the cam member and the upright.

* * * * *